United States Patent [19]

Füllemann et al.

[11] Patent Number: 4,861,216

[45] Date of Patent: Aug. 29, 1989

[54] FEEDING DEVICE FOR FEEDING PULVEROUS OR GRANULAR MATERIAL FROM A CONTAINER TO A MATERIAL CONSUMING APPARATUS

[75] Inventors: Jörg Füllemann, Mastrils; Heinrich Boner, Malans; Erik Granwehr, Mastrils, all of Switzerland

[73] Assignee: VTH AG, Vaduz, Liechtenstein

[21] Appl. No.: 143,472

[22] Filed: Jan. 13, 1988

[30] Foreign Application Priority Data

Jan. 15, 1987 [CH] Switzerland ..... 130/87

[51] Int. Cl.[4] ..... B65G 65/00

[52] U.S. Cl. ..... 414/326; 222/242; 198/533; 198/550.1

[58] Field of Search ..... 414/310, 319, 320, 321, 414/326; 198/533, 550.1; 222/239, 242 X, 249

[56] References Cited

U.S. PATENT DOCUMENTS

| | | | |
|---|---|---|---|
| 1,724,805 | 8/1929 | Root | 222/242 |
| 3,320,639 | 5/1967 | Harp | 198/533 X |
| 3,481,512 | 12/1969 | Scheffer et al. | 198/550.1 X |
| 3,496,601 | 4/1967 | McGill | 198/550.1 |
| 3,722,666 | 3/1973 | Uim et al. | 198/550.1 X |

FOREIGN PATENT DOCUMENTS

| | | | |
|---|---|---|---|
| 855677 | 11/1952 | Fed. Rep. of Germany | 222/242 |
| 113036 | 7/1983 | Japan | 414/310 |
| 207223 | 12/1983 | Japan | 414/326 |

*Primary Examiner*—Robert J. Spar
*Assistant Examiner*—James R. Bidwell

[57] ABSTRACT

A container (10) comprising a trough (23) is filled with pulverous or granular material, for example a neutralizing agent for sulphuric acid. At the place where the container (10) is used, for example on a waste gas cleaning apparatus, a subassembly (27') is pushed through an opening (20). The subassembly (27') comprises substantially an axial feed member (29) having the form of a helical spring, a loosening member (31), a rotatable shaft (33), and a coupling member (35). When rotational motion is transmitted from a drive to the coupling member (35) the screw (39) is rotated and the loosening member (31) which is periodically pressed by the trough (23) against the screw (39) loosens the granular or pulverous material, so that it glides towards the axial feed member (29). The axial feed member (29) transports the material from the interior of the container (10) to the outlet (53). When the container (10) is empty, the subassembly (27') is removed and inserted into a new container (10). The old container may then be discarded.

22 Claims, 4 Drawing Sheets

FEEDING DEVICE FOR FEEDING PULVEROUS OR GRANULAR MATERIAL FROM A CONTAINER TO A MATERIAL CONSUMING APPARATUS

The present invention relates to a feeding device for feeding pulverous or granular material from a container to a material consuming apparatus and more particularly to a feeding device for a feeding a pulverous or granular neutralizing agent to an apparatus for cleaning waste gases from heating systems.

BACKGROUND

U.S. Pat. No. 4,686,940 describes a device for cleaning waste gases from heating systems, in particular heating systems for single or multiple family houses. On this cleaning device the waste gas from the boiler is fed through a chamber in which a mist or rain of a liquid is generated. Periodically, controlled by a control device, milk of lime is added as neutralizing agent to the water in the container. The feeding of neutralizing agent occurs by hydraulic pressure. This is controlled by a magnet valve. This causes water to flow into the neutralizing agent storage means so that neutralizing agent is fed over a pipe into the container in which the cleaning of the waste gas takes place. Because the suspension of lime in water has the tendency to solidify in time, clogging may occur so that no neutralizing agent is anymore transported. If the acid condensates are not anymore neutralized they can cause corrosion and thus destruction of the waste gas cleaning device.

It would seem advisable to use pulverous or granular neutralizing agents instead of liquid neutralizing agents or suspensions of solid neutralizing agents in water. For example, caustic lime could be used as neutralizing agent. However, caustic lime and also some other pulverized and granular neutralizing agents are relatively dangerous substances which can cause cauterization or burns. A special danger occurs when such substances enter the eyes. In addition, the feeding of pulverized substances is considerably more difficult than feeding of fluid substances. Fluid substances can be easily fed by means of valves or pumps. This may be the reason why up to the present time pulverous or granular neutralizing agents have not found application in waste gas cleaning apparatus of small or medium size.

There exist feeding devices for feeding pulverous or granular material from a container to a consuming device by means of an axial feeding member, for example a screw. However, pulverous material has a tendency to stick or clump together. Accordingly, screw feeding devices may turn empty, that is may not feed material, if not additionally vibrators are provided to cause a steady gliding down of material towards the feed screw. But sometime vibrators do not have the desired effect. They also generate undesirable noise.

THE INVENTION

It is an object of the present invention to provide a feeding device for feeding pulverous or granular material from a container to an apparatus consuming such material, and more particularly for use in exchangeable containers, which permits the transport of pulverous or granular material without danger. The feeding device should be easy to insert into the container, and the container should be easy to position on the apparatus using the pulverous or granular material. It is further an object of the present invention to provide a feeding device not requiring vibrators but nevertheless providing a secure gliding down of the pulverous or granular material in the container to the axial feeding device for further transportation by said axial feeding device.

Briefly, a movable loosening member is located at a distance from the axial feed member. In accordance with the present invention, thus, in operation of the feeding device, the loosening member loosens the material in the neighbourhood of the axial feed member so that it always engages and transports material when the material consuming apparatus requires such material.

The axial feed member and the loosening member are preferably driven by a common drive means. This has the advantage that a single drive means is sufficient to carry out the feeding and loosening operations.

It is of advantage to use a screw as axial feed member. Accordingly, a rotary motion is sufficient to provide a feeding action in axial direction. It is of particular advantage if the screw has the form of a helical spring with spaced windings. This is not only an inexpensive design but has the additional advantage that the helical winding can easily be introduced into an opening of a container filled with the pulverous or granular material. The helical spring can be screwed without much effort into the pulverous or granular material. Preferably, the helical spring is connected to a shaft capable of being driven by the drive means. On the shaft a coupling member may be provided to couple the axial feed member and the loosening member to the drive means. This permits the location of the container with the feeding device on an apparatus requiring the material in the container and having drive means to operate the feeding device.

The loosening member is preferably flexible, for example a flexible wire. This permits the loosening member to scan a relatively large region and to loosen within its reach the pulverous or granular material. The loosening member may comprise an exterior section which, in unloaded condition of the loosening member, extends at a distance from the axial feeding member and practically parallel thereto. Further, it is preferred that the part of the loosening member which extends from the shaft to the exterior part is located at an acute angle to the axis of the axial feeding member. This permits, on insertion of the axial feed member into the container, to press the loosening member with the fingers of the hand towards the axial feed member and then to push them together through the opening of the container. This causes the loosening member to be further pressed against the axial feeding member, but after complete introduction into the container the loosening member can relax, because it is flexible. Preferably, the free end of the exterior part of the loosening member is bent to form a hook pointing in direction of rotation of the screw. When the screw rotates this hook digs into the material and loosens it, so that it is moved towards the screw. A trough may be provided underneath of the axial feed member. This trough cooperates with the axial feed member. The cross-section of the bottom of the trough has preferably a radius. The distance of the axial feed member from the bottom of the trough is preferably smaller, for instance two to three times smaller, than the radius of the bottom of the trough. This has the effect that, on rotation, the loosening member touches with its exterior part the sidewalls and the bottom of the trough. This causes sticking material to become loose, and the loose material is then engaged by the axial feed member and transported by it. It has been found to be of advantage if said distance of the axial feed member from the bottom of the trough is for example two to three times shorter than the radius of the bottom of the trough. The trough preferably .has slightly movable and/or flexible walls. Accordingly, when the loosening device contacts the trough the trough is somewhat moved and/or deformed on each revolution. The movement of the trough walls with respect to the container walls causes the pulverous material to glide downward from the upper regions into the region where the axial feed member is located and where it will be transported by it.

Advantageously, one end of the axial feed member is rotatably supported in a tubular bushing, said bushing being provided with a peripheral opening providing an outlet for the material being fed. The axial feed member, the loosening member, the shaft and the coupling member may form a subassembly. Such a subassembly can then be pushed through the opening of a container until it is stopped by an abutment.

DRAWINGS

DETAILED DESCRIPTION

Figure 1:
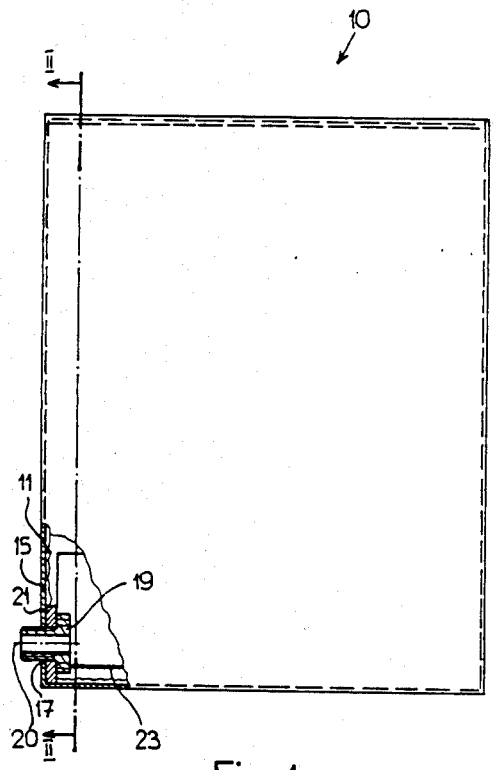
FIG. 1 is a schematic view, partly in section, of an exchangeable container according to a first embodiment.
Figure 2:
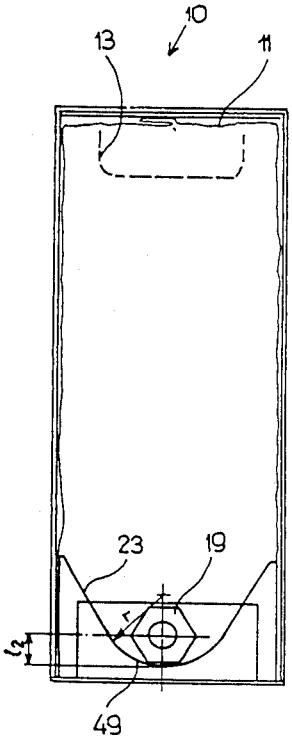
FIG. 2 is a section along the line II—II of FIG. 1.
Figure 3:
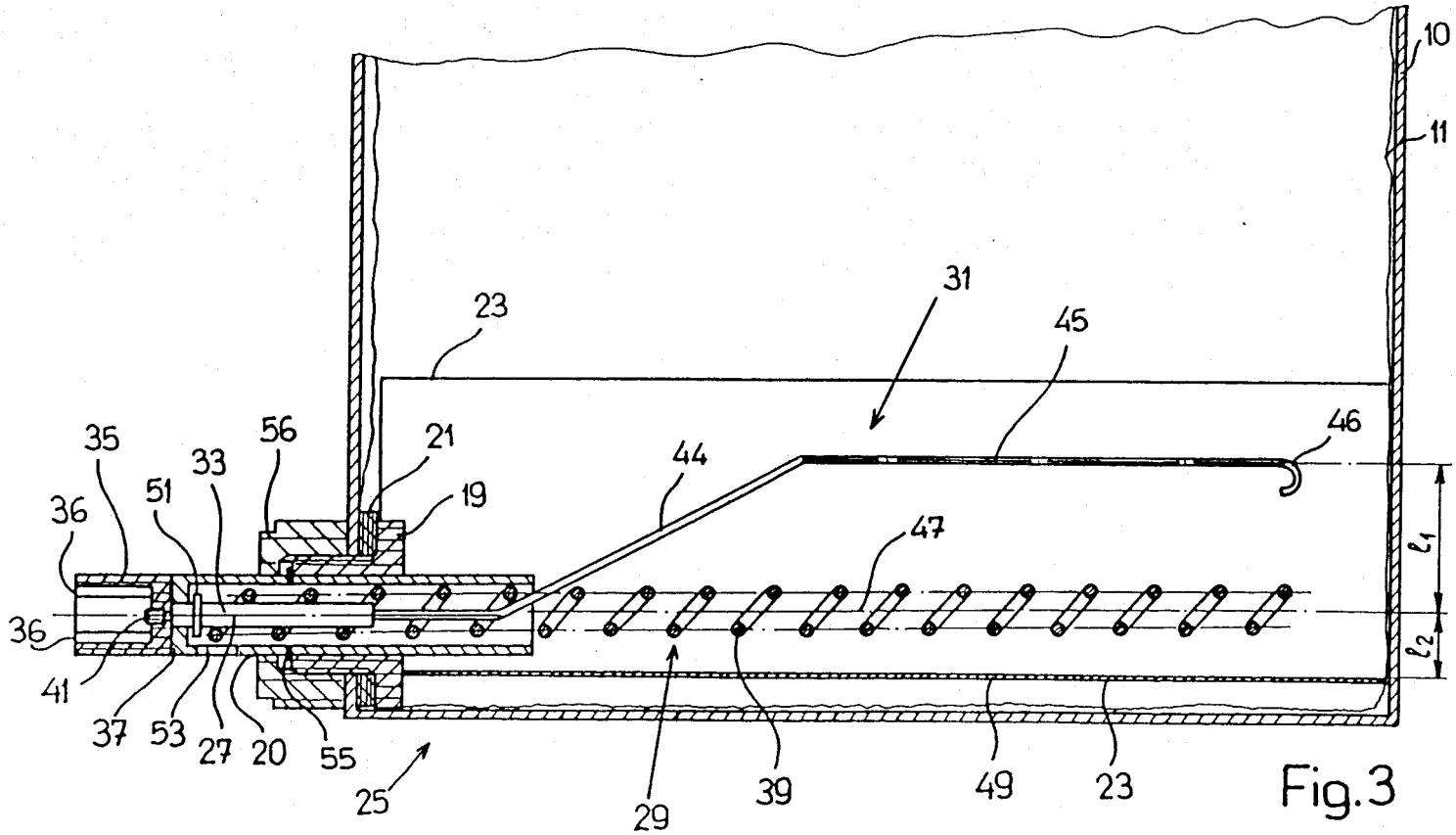
FIG. 3 is a longitudinal section through the container of FIG. 1 and ,the feeding device.

The exchangeable container according to FIGS. 1 to 3 is preferably a moisture-proof cardboard box. If the cardboard box is not moisture-proof the pulverous or granular material should be in a bag, preferably a plastic bag which in FIGS. 2 and 3 is indicated by the reference numeral 11. Instead of a cardboard container also a container of plastic material or metal could be used. However, cardboard boxes are very inexpensive and disposable without ecological problems. On a cardboard container handles may be provided by cuts 13.

For clarity of representation the container 10 is shown in FIGS. 1 to 3 in empty condition. In the lower part of a side wall 15 the container 10 has an opening 17 in which a hollow screw 19 of plastic material is located. The hollow screw 19 is connected to a plate 21 of plastic material. This plate 21 prevents rotation of the screw.

Figure 4:
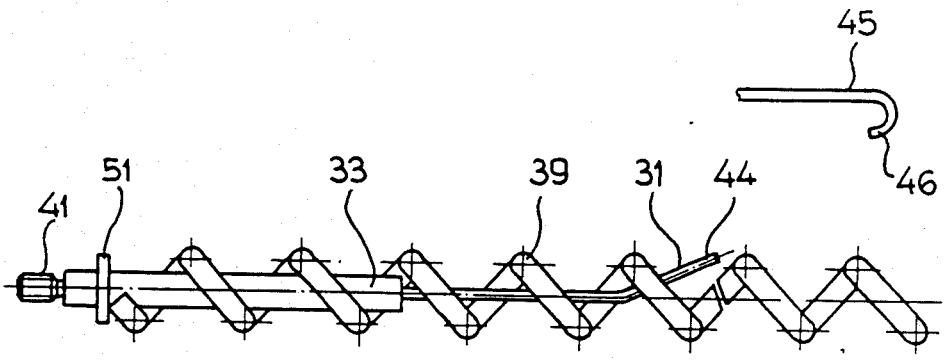
FIG. 4 is a view of the axial feeding member together with the loosening, member.
Figure 5:
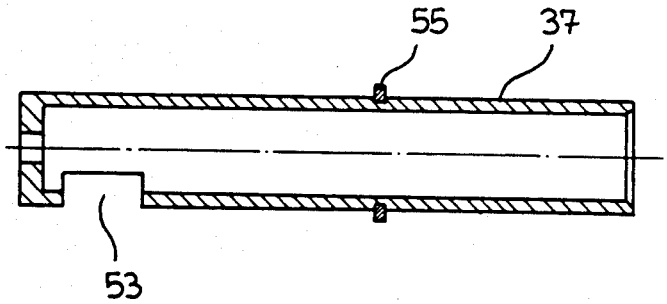
FIG. 5 is a section through the bushing in which the axial feeding/;member is rotatably supported at one end.

The feeding device 25 which is shown in details in FIGS. 3 to 5 comprises substantially a subassembly 27 and a trough 23. The trough 23 may be of plastic material and is located at the bottom of the container 10. The subassembly 27 can be inserted into the container 10 through an opening 20. If it is acceptable that the feeding device 25 does not practically completely empty the container 10 the trough 23 could be omitted.

On this embodiment the subassembly 27 comprises an axial feeding member 29, an loosening member 31, a shaft 33, a coupling; and member 35 and a bushing 37.

The axial feeding member 29 is a kind of feed screw which is formed by a helical spring 39 having spaced windings. The helical spring 39 consists of relatively thick wire, e.g. of the stainless steel, and therefore is relatively stiff. Accordingly, in this description the expression helical spring is mainly used to designate the form. On the side of the drive means the helical spring 39 is mounted on the shaft 33, e.g. by brazing. The shaft 33 has a threaded portion 41 on which the coupling member 35 is threaded. This coupling member 35 has claws 36 engaging a coupling member (not shown) of the drive means 43 (FIG. 6).

One end of the loosening member 31 which may be made of stainless spring steel is connected to the shaft 33. Accordingly, in operation, the loosening member 31 is rotated together with the helical spring 39. On the embodiment shown the loosening member 31 comprises a flexible piece of wire. The interior part 44 of this piece extends at an acute angle to the axis 47. In unloaded condition the exterior part 45 is located practically parallel to the axis 47 and comprises at its end a hook 46 extending approximately in direction of rotation of the axial feed member 29. The distance $1_1$ between the exterior part 45 and the axis 47 is about three times larger than the distance $1_2$ of the axis 47 from the bottom 49 of the trough 23. The distance $1_2$ is approximately two to three times smaller than the radius r (FIG. 2) of the bottom 49 of the trough. Accordingly, when rotated, the exterior part 45 of the loosening member 31 wipes the bottom 49 of the trough 23. One end of the axial feed member 29, that is the part 44 of the helical spring 39 which is connected with a shaft 33, is located in the tubular bushing 37. An axial movement is prevented on one hand by a flange 51 and on the other hand by the coupling member 35. At the end of the bushing 37 located outside of the container 10 is a peripheral opening 53 serving as outlet for the transported material. On the bushing 37 is a snap ring 55 preventing an axial movement of the bushing when a cap screw 56 is screwed on the hollow screw 19.

Figure 6:
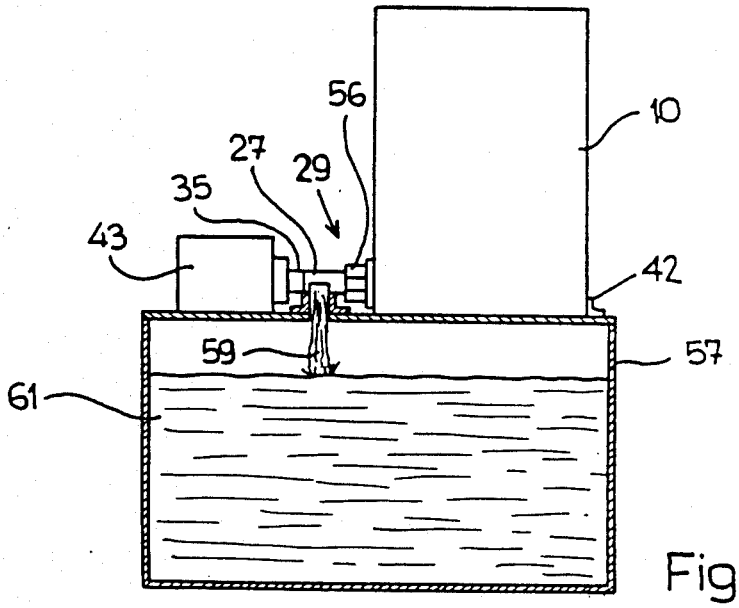
FIG. 6 is a schematic view of an exchangeable container on a flue gas cleaning installation, said container containing neutralizing agent.

As FIG. 6 schematically shows, the container 10 can be employed on a consuming device, e.g. a waste gas cleaning apparatus 57. When the container 10 is placed on the consuming device the feeding device 25 is engaged with the drive means 43. As drive means 43 an electric motor may be used which is set in operation on demand. When the feeding device 25 is rotated neutralizing agent 59 is added to the water 61 of the waste gas cleaning apparatus 57.

An exchange of an empty container 10 by a full container takes place as follows: The empty container 10 is taken from the consuming device 57. The cap screw 56 is removed, and the subassembly 27 is pulled out from the container 10. Because a new container 10 is closed by a screw cap (not shown) threaded on the thread of the hollow screw 19, this screw cap is first removed and then the subassembly 27 is pushed through the opening 20 into the container 10. Then the subassembly 27 is fixed with the screw 56 in the axial position shown in FIG. 3. Now the container 10 can be put on the consuming device 57.

Figure 7:
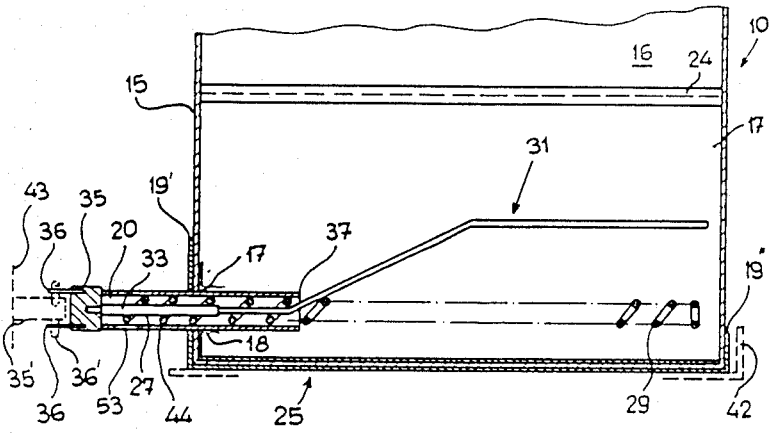
FIG. 7 is a longitudinal section through a container with feeding device, according to a second and preferred embodiment of the invention.
Figure 8:
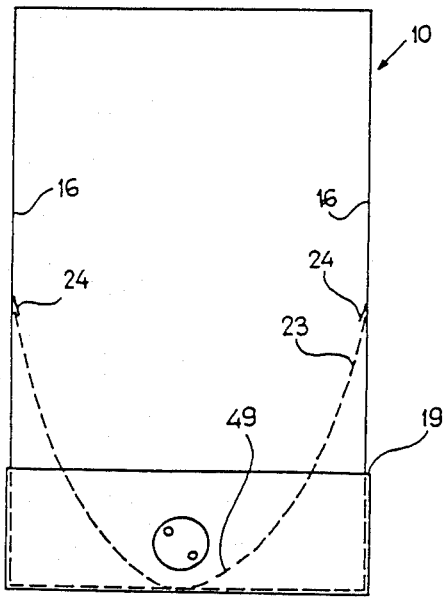
FIG. 8 is a side view of the container with feeding device according to FIG. 7.

The preferred embodiment according to FIGS. 7 and 8 comprises a particular simple and safely operating feeding device which is similar to that of FIGS. 1 to 5. Accordingly, the same reference numerals designate parts having the same functions. For details reference may be made to the previous description.

The container 10 is preferably a cardboard container of the kind generally used for washing powder. Such containers are moisture-proof, so that no additional plastic bag is required to provide protection from moisture.

In the lower part of the sidewall 15 an opening 17 is provided. In contrast to the first embodiment no hollow screw with a screw cap is required. Accordingly, such disposable parts of plastic material are avoided, which is advantageous for ecological reasons. The opening 17 is closed with a closure foil, for example an adhesive tape 18 or the like. On insertion of the bushing 37 this closure foil is pierced.

Located in the container 10 is a trough 23 which may consist of a thin plate of plastic material having its lateral walls connected with adhesive tape 24 on the inner walls 16 of the container.

The bushing 37 is connected on a receptacle 19'. To place the container 10 into the receptacle 19' it is put with the opening 17 directed towards the bushing 37 on the receptacle 19' and then pushed against the bushing 37. After the bushing 37 has pierced the closure foil 18 and has further entered into the container 10, the container 10 comes to a rest in the position shown in FIG. 6. In this position a rim 19'' encloses the container 10 and prevents it from sliding off therefrom.

As on the first embodiment described previously, the feeding device 25 of the second embodiment comprises substantially a subassembly 27' and a trough 23. The subassembly 27' can be inserted through the opening 20' of the bushing 37.

On this preferred embodiment the subassembly 27' comprises an axial feed member 29, a loosening member 31, a rotatable shaft 33 and a coupling member 35. In contrast to the first embodiment, the bushing 37 does not belong to the subassembly 27, but is connected to the receptacle 19' The container 10 can be inserted together with the receptacle 19' on a consuming device, for instance a waste gas cleaning apparatus 57, as shown in FIGS. 6 and 7. Claws 36 (FIG. 7) engage claws 36' so that the shaft 33 is coupled to the drive means 43. The abutment 42 on the apparatus 57 fixes the container 10 in its position thereon.

Replacement of an empty container 10 by a full container takes place as follows:

The empty container 10 is taken together with the receptacle 19' from the consuming device 57. Then the subassembly 27' is pulled out of the container 10, and then the empty container 10 is taken off from the receptacle 19'.

The new container is pushed into the receptacle 19', thus causing the bushing 37 to pierce the foil 18. Then, the subassembly 27' is pushed through the bushing 37 into the container 10.

OPERATION

In operation the feeding device operates as follows: If pulverous or granular material must be fed from the container 10 to the consuming device 57 the motor 43 is operated. By the coupling member 35 rotation is transmitted to the subassembly 27 (27'). Accordingly, the axial feed member 29 is also rotated so that by the windings 39 the powdery or granular material 59 is fed through the bushing 37 to the opening 53 and therefore into the consuming device 57. The loosening member 31 is rotated in the pulverous material so that this material is moved into the region of the windings 39 and transported by these windings. On its rotation the exterior part 45 contacts the trough 23, and, in the region of the bottom 49 of the trough 23 is pressed in close proximity of the axial feed member 29. During the further rotation the exterior part 45 flexes back approximately into the position shown in FIG. 3. By this operation the pulverous or granular material is loosened and gets, as already mentioned, into the region of the axial feed member 29. The loosening of material is further facilitated by the slight deformation and motion of the walls of the trough 23 caused by contacts of the loosening member 31 on each of its revolutions.

While the invention has been particularly shown and described with reference to embodiments thereof, it will be understood by those skilled in the art that various alterations in form and detail may be made therein without departing from the spirit and scope of the invention.

The embodiments of the invention in which exclusive property or privilege is claimed are defined as follows:

We claim;

1. A feeding device for feeding pulverous or granular material from a container to an apparatus for receiving said material, said container having sides and a substantially horizontal bottom thereof, said feeding device comprising:

axial feed means having its axis located substantially parallel to and at a predetermined distance $1_2$ from the bottom of said container;

movable, flexible loosening means and means for rotating said loosening means about said axis for loosening said material in said container, said loosening means having at least an exterior section thereof being located, when furthest from said bottom, at a distance $1_1$ from said axis, said distance $1_1$ of said loosening means from said axis of said feed means being larger than said predetermined distance $1_2$ so that scraping of said bottom by said exterior section of said loosening means occurs during each revolution of said loosening means about said axis.

2. The feeding device of claim 1 wherein said axial feed means comprises a feed screw.

3. The feeding device of claim 1 wherein said axial feed means comprises a helical spring having spaced windings.

4. The feeding device of claim 1 wherein said loosening means is connected with one end to the axial feed means.

5. The feeding device of claim 1 wherein said loosening means comprises said exterior section and an interior section, said interior section extending away from said drive shaft at an acute angle towards said exterior section.

6. The feeding device of claim 1, including a common drive means for driving said axial feed means and said means for rotating said loosening means.

7. The feeding device of claims 1 wherein said exterior section terminates in a hook.

8. The feeding device of claim 1 including a drive shaft and a coupling means for coupling said axial feed means and said loosening means to said drive shaft; and, wherein said axial feed means, said loosening means, said drive shaft, and said coupling means form a subassembly.

9. The feeding device of claim 1 wherein said axial feed means is operative for feeding said material out of said container and wherein said axial feed means comprises;

a common drive means;

a helical spring having spaced windings;

a drive shaft for rotating said helical spring;

bearing means for rotatably supporting said drive shaft; and, coupling means for coupling said axial feed means and said loosening means to said common drive means.

10. The feeding device of claim 1 including a trough having a round cross-section located at the bottom of said container for facilitating feeding of said material, said trough being located in said container underneath said axial feed means.

11. The feeding device of claim 10 wherein said axial feed means comprises a feed screw.

12. The feeding device of claim 10 wherein said axial feed means comprises a helical spring having spaced windings.

13. The feeding device of claim 10 wherein said loosening means is connected with one end to the axial feed means.

14. The feeding device of claim 10 wherein the distance of said axial feed means from said bottom is about 2–3 times shorter than the radius of said round cross-section of said bottom.

15. The feeding device of claim 10 wherein said trough has flexible walls.

16. The feeding device of claim 15 wherein said trough is comprised of a thin plate fastened at its edges to two opposing inner walls of said container.

17. The feeding device of claim 1 including a receptacle for receiving said container.

18. The feeding device of claim 1 including a receptacle for receiving said container and wherein a bearing means is mounted on said receptacle.

19. The feeding device of claim 1 wherein the distance of said loosening means from the axis of said axial feed means is about 2–3 times larger than the distance of said axis from said bottom.

20. The feeding device of claim 18 wherein said trough has flexible walls.

21. The feeding device of claim 19 wherein said trough is comprised of a thin plate fastened at its edges to two opposing inner walls of said container.

22. A feeding device for feeding pulverous or granular material from a container to an apparatus for receiving said material, said container having sides and a substantially horizontal bottom thereof, said feeding device comprising:

axial feed means having its axis located substantially parallel to and at a predetermined distance $1_2$ from the bottom of said container;

movable, flexible loosening means and means for rotating said loosening means about said axis for loosening said material in said container, said loosening means having at least an exterior section thereof being located, when furthest from said bottom, at a distance $1_1$ from said axis;

said distance 11 of said loosening means from said axis of said feed means being larger than said predetermined distance $1_2$ so that scraping of said bottom by said exterior section of said loosening means occurs during each revolution of said loosening means about said axis; and, wherein said axial feed means comprises:

a common drive means;

a helical spring having spaced windings;

a drive shaft to which said helical spring is connected;

bearing means for rotatably supporting said drive shaft;

coupling means for coupling said axial feed means and said loosening means to said common drive means;

a trough having a bottom of round cross-section for facilitating feeding of said material, said trough being located in said container underneath said axial feed means; and, wherein said bearing means comprises a tubular bushing, said bushing being provided with a peripheral opening to provide an outlet for the material being fed.

* * * * *